United States Patent [19]

Getz

[11] 3,964,630

[45] June 22, 1976

[54] GARBAGE CAN FOR USE WITH DISPOSABLE BAGS

[76] Inventor: Donald J. Getz, 1741 Sycamore, Hanover Park, Ill. 60103

[22] Filed: Oct. 16, 1974

[21] Appl. No.: 515,147

[52] U.S. Cl. ..... 220/63 R; 220/1 T; 220/4 R; 248/95

[51] Int. Cl.[2] ..... B65D 25/16

[58] Field of Search ..... 220/1 T, 63 R, 18, 4 R; 248/DIG. 7, 95, 99

[56] References Cited

UNITED STATES PATENTS

| | | | |
|---|---|---|---|
| 816,989 | 4/1906 | Moler et al. | 220/1 T |
| 1,013,775 | 1/1912 | Hoffman | 220/1 T |
| 1,037,265 | 9/1912 | Kirkpatrick | 248/99 |
| 1,130,086 | 3/1915 | Hobbs | 220/1 T |
| 1,238,090 | 8/1917 | Beringer | 220/1 T |
| 1,637,131 | 7/1927 | Rigby | 248/95 |
| 2,436,109 | 2/1948 | Kollman | 220/18 |
| 3,191,798 | 5/1965 | White et al. | 220/65 |
| 3,402,848 | 9/1968 | Busey | 220/1 T |
| 3,741,434 | 6/1973 | Traverse | 220/1 T |

FOREIGN PATENTS OR APPLICATIONS

| | | | |
|---|---|---|---|
| 387,241 | 1/1965 | Switzerland | 248/95 |

*Primary Examiner*—William Price
*Assistant Examiner*—Joseph M. Moy
*Attorney, Agent, or Firm*—Hill, Gross, Simpson, Van Santen, Steadman, Chiara & Simpson

[57] ABSTRACT

A garbage container for use with disposable bags employing a locking device for securing the top of a disposable bag in open position interior of the container and an opening in the top of the container for access to the interior. The bottom of the container opens to permit release of the enclosed bag or bags and the intermediate portion is provided with a decreasing cross-section from bottom to top to prevent binding between the disposable bag to be released and the container walls.

6 Claims, 6 Drawing Figures

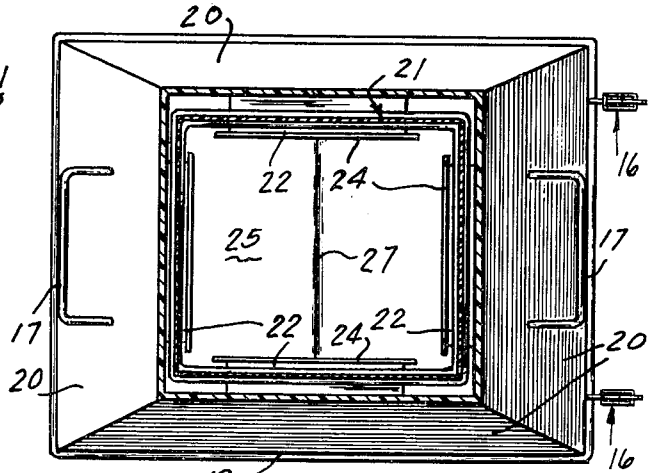
Fig. 4
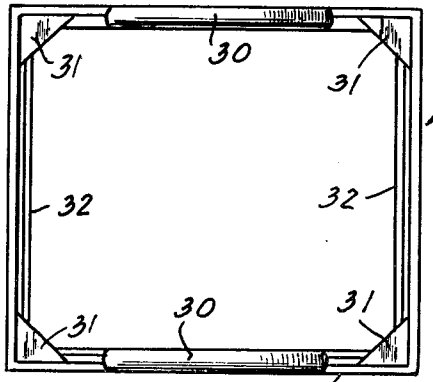
Fig. 5
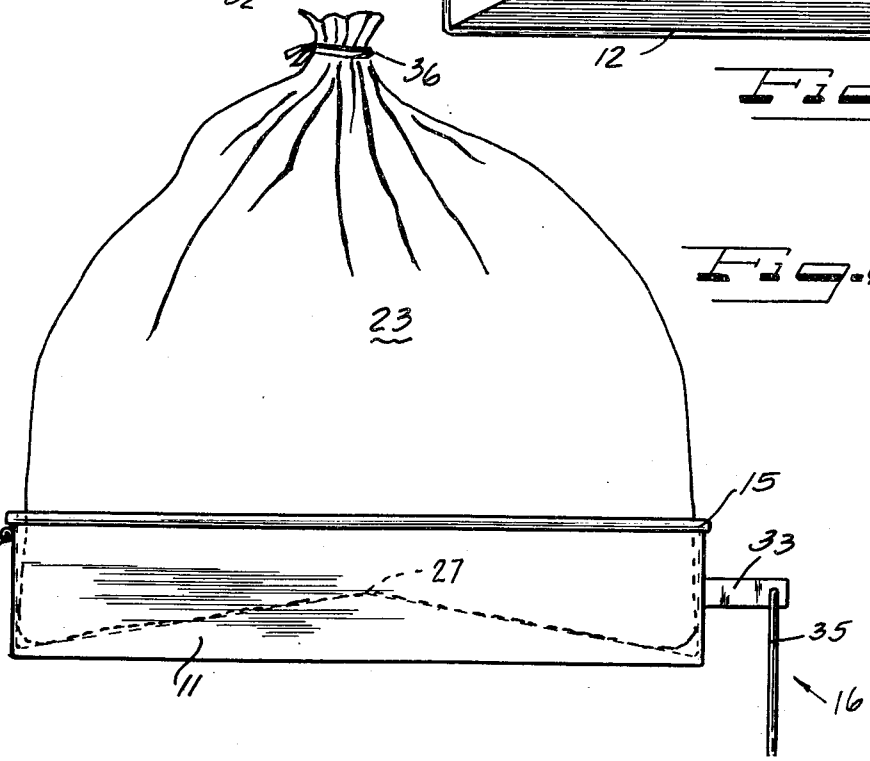
Fig. 6
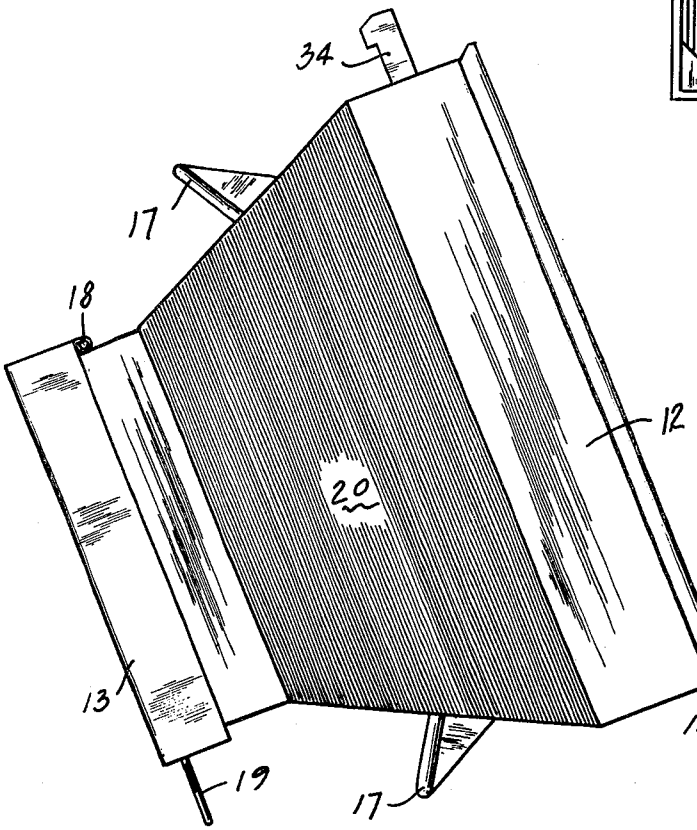

GARBAGE CAN FOR USE WITH DISPOSABLE BAGS

BACKGROUND OF THE INVENTION

1. Field of the Invention

This invention relates to a receptacle with a separate inclosure therein, and more particularly to receptacles for containing garbage disposal bags.

2. Description of the Prior Art

The concept of one container within another container for the storage of garbage has been well developed in the prior art. Two principal disadvantages associated with such an arrangement are the binding contact between the side walls of the container and the disposal bag when the interior is filled and the difficulty encountered in securing the top of the flexible bags in the interior of the one container in an open position.

U.S. Pat. No. 1,836,297 to Vienna suggests the use of an inner container with a narrower dimension to allow for expansion of the sack. One disadvantage of this approach is the requirement of an interior bag of a particular dimension and sufficient stiffness to prevent binding contact when the interior bag is filled.

The use of a tapered outer container with increasing cross-section from bottom to top is taught by U.S. Pat. No. 3,191,798 to White et al. Although the tapering improves the ease of inner container removal, binding contact is still a problem. The reference also teaches the use of a flanged rim around the top to secure an opening in the top of the inner bag. Careful placement of the lock rim is required to insure an adequate opening.

Clearly, it is highly desireable to provide a technique for inner bag removal with a minimum of binding and a locking device for securing the top of the inner bag whch may be deployed with ease and rapidity without careful arrangement of the bag opening.

SUMMARY OF THE INVENTION

The principal objects of this invention are to provide a garbage disposal container from which inner disposal bags may be easily removed and a convenient locking device which can be quickly engaged to maintain an opening at the top of the inner bag which may be deployed with ease and rapidity.

A further object of the invention is to arrange the container to accept a wide variety of disposal bags of various shapes, strength, and rigidity.

According to the invention, a disposable garbage bag is placed through the opening of the top of an intermediate section of the container. The top edges of the interior bag are flared out and a bag locking piece which rests in an interior groove constructed at the top of the container is placed over the flared edges. As garbage is placed through the top opening of the interior bag, the walls of the bag expand until they contact the sides of the outer container. A hinged top section is provided to cover the top of the container and to prevent odors from escaping. When the container is full, the bag locking device is removed and the top of the bag may be tied off. A bottom of the container is hinged, thereby allowing the intermediate and top sections of the container to be folded back, thereby exposing the interior garbage bag. Since the cross-section of the intermediate section decreases from bottom to top, the interior bag, which has been filled with garbage and may thereby contact the inner walls of the container, does not grip the sides and the weight of the garbage is sufficient to insure release. The floor of the bottom section of the container is centrally peaked to force the accumulating garbage to distribute itself around said peak, thereby creating a stable base to prevent tipping of the garbage bag when the container intermediate section is folded back. A locking device is provided to secure the bottom section of the container to the intermediate section. Carrying handles are located on either side of the intermediate section for transporting the container.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

FIG. 4 is a cross-section view taken along lines IV-IV of FIG. 3.

FIG. 5 is a top plan view of the bag locking piece.

FIG. 6 is a side view of the garbage container showing the top and intermediate sections in an open position to expose a filled garbage bag with underlying portions shown by broken lines.

DESCRIPTION OF THE PREFERRED EMBODIMENTS

Figure 1:
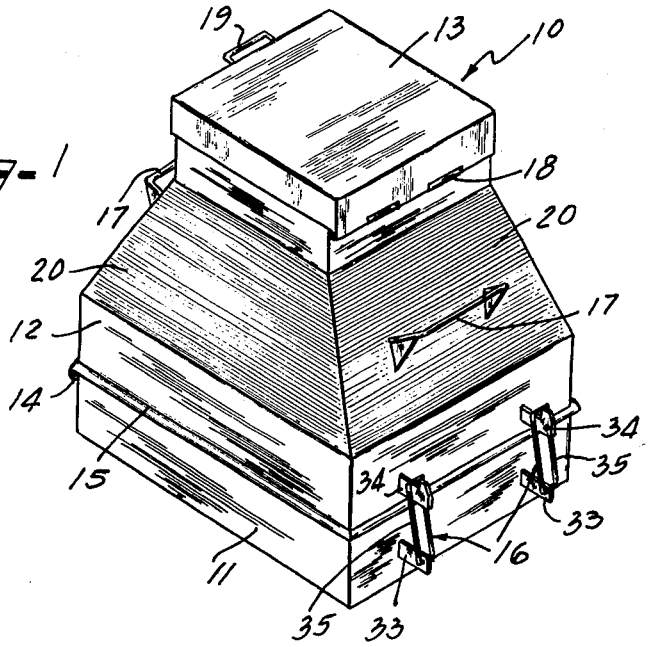
FIG. 1 is a perspective view of a preferred embodiment of the garbage container.
Figure 3:
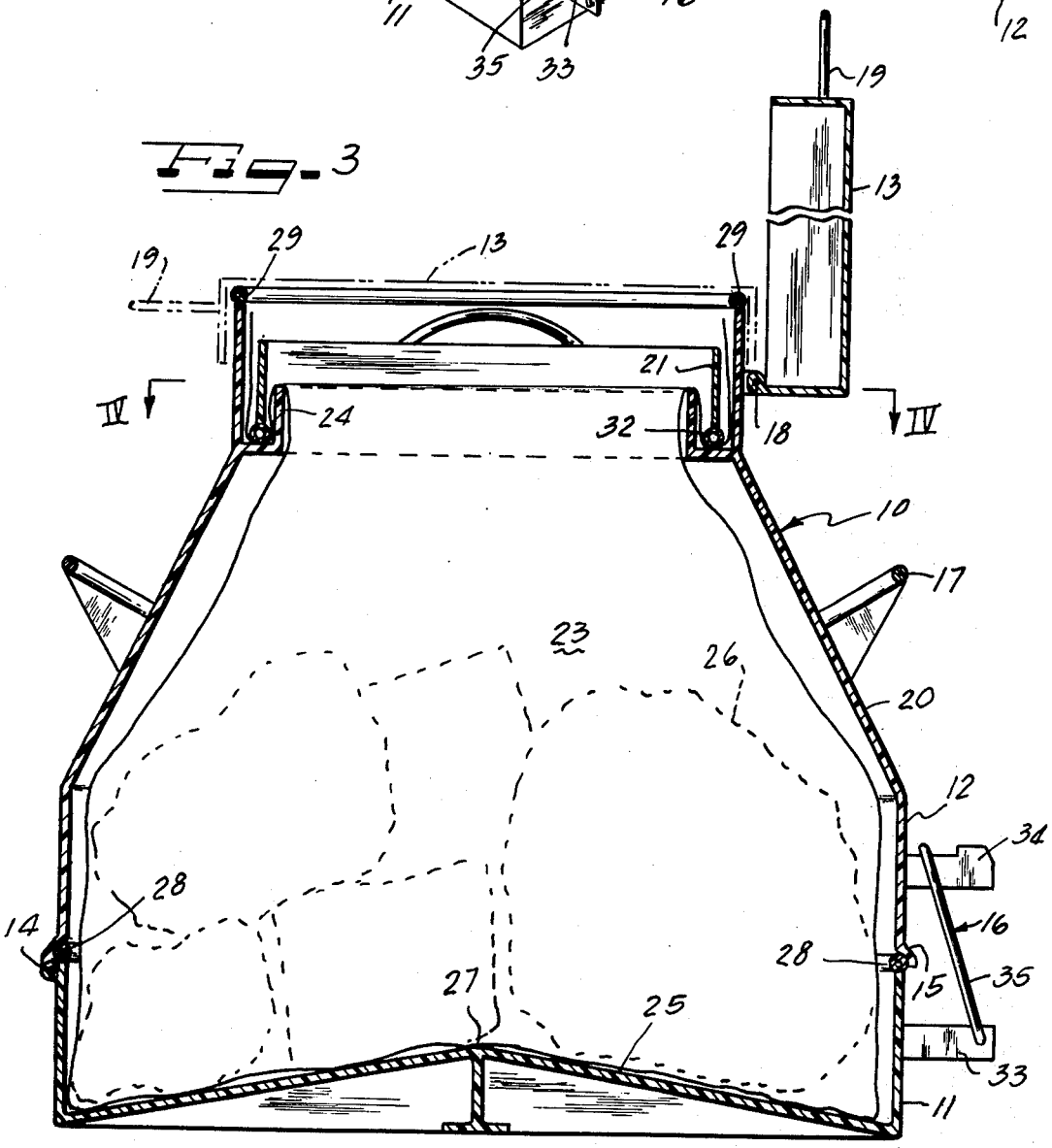
FIG. 3 is a cross-sectional side view of the garbage container illustrating the peaked floor of the bottom section, bag locking mechanism, the open position of the top section, and in broken lines, the top section in a closed position.

Referring to FIGS. 1 and 3, a garbage container 10 is generally illustrated with bottom section 11, intermediate section 12, and top section 13. In the embodiments illustrated, each section has a rectangular horizontal cross-section. An alternative embodiment may have a circular horizontal cross-section or the like.

The bottom section 11 is connected to intermediate section 12 by hinge 14 to permit the intermediate section to swing open for access to the interior. A radial rim 28 is located on the top perimeter of the bottom section to provide a seat for the intermediate section. A flanged rim 15 located on the intermediate section serves as a stable surface and guide for closure of the bottom and intermediate sections by providing a large contact area and matching engagement between the flange 15 and radial rim 28.

Locking devices 16 secure the bottom and intermediate sections together until removal of the interior bag. The locking devices are comprised of lower and upper support members 3 and 34 with latch arm 35 communicating between them.

A floor portion 25 of bottom section 11 is peaked in the middle with the center junction 27 of the sloping sides being parallel to hinge 14. As garbage 26 falls to the bottom, a distribution of weight occurs on either side of the peak, thus establishing a firm foundation for the garbage bag when intermediate section 12 swings open. It should be understood that other floor structures with central peaking may be used such as pyramid, conical, or dome shaped. Also, the peaked floor is useful if more than one interior garbage bag is used. If smaller bags are used, they may be filled and tied off while separate from or secured within the container. As they are dropped to the bottom, the individual bags will distribute to the sides of the peaked portion, thus permitting an even packing of the container interior without the necessity of manually positioning the interior bags.

Carrying handles 17 located on the intermediate section 12 are provided for convenient movement of the container 10. They also aid in opening the intermediate section when removing the filled garbage bag or bags.

Intermediate section 12 has sloping side walls 20 which provide an increasing cross-section from the top to bottom as a means to minimize or prevent any gripping between an inner bag filled with garbage and the intermediate section. The weight of the garbage is more than sufficient to pull the bag down and free from the outward sloping walls.

Top section 13 is connected to the intermediate section 12 by hinges 18 to permit the top section to swing open for access to the interior of the container. The hinges are located opposite the bottom section hinge 14 to prevent the top section from accidentally opening when the intermediate section swings back to expose the interior garbage bag 26. A radial rim 29 is joined to the top perimeter of the intermediate section 12 to provide a resting point and partial seal for the top cover section. The top section is comprised of a top wall and short surrounding side walls which overlap the radial rim 29. A handle 19 is provided for lifting the top section to a typical open position shown at 13.

The design and operation of a bag locking device 21 is best illustrated by FIGS. 2, 3, 4, and 5. The locking piece rests over the top walls of the interior bag in four grooves 22 located interiorly of the top opening of the intermediate section 12. Each groove is three sided and rectangular in vertical cross section. Sufficient distance remains between the interior groove walls and the locking piece in the illustrated embodiment to permit a loose fit and room for the flexible bag walls. The weight of the locking piece secures the bag in an open position. However, it should be understood that if a tight, wedge fit is desired, the interior groove side walls may be closely spaced to provide a tight contact between the locking piece, bag wall 23, and the groove 24 walls.

Figure 2:
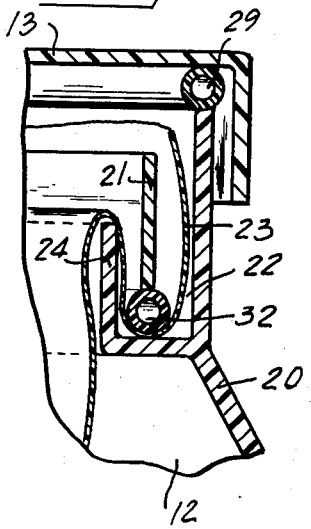
FIG. 2 is a fragmentary cross-sectional view of the top section and the locking mechanism for maintaining an opening in the top of the interior garbage bag.

A radial rim 32, most clearly illustrated in FIGS. 2 and 3, surrounds the bottom perimeter of locking piece 21 to provide a rounded surface for a smooth insertion into the groove 22.

Corner support members 31 shown in the removed locking piece illustrated in FIG. 5 provide rigidity for the locking piece walls by providing greater contact surface at the corners. Each corner piece is preferably triangular in horizontal cross-section but may also be rectangular. Two radial handles 30 are connected to the locking piece for placement and removal.

FIG. 6 illustrates a feature of the device for allowing simplified disposal bag removal. Peaked floor 27 supports the garbage bag 23 in an upright position when locking device 16 is unlatched and intermediate section 12 swings open. In the preferred embodiment, the top opening 36 of garbage bag 23 is tied prior to opening the intermediate section 12. However, it should be understood that the garbage bag may be tied after removal of the intermediate section. Furthermore, small garbage bags may be filled, tied off, and dropped into the container via the top opening of intermediate section 12.

Although the teachings of my invention have herein been discussed with reference to specific theories and embodiments, it is to be understood that these are by way of illustration only and that others may wish to utilize my invention in different designs or applications.

I claim as my invention:

1. A container for encasing and releasably supporting a disposable garbage bag in position to be filled through a reduced size open top that is easily tied closed and accommodating expansion of the bag along a gradually increasing intermediate portion to a full size bottom portion which comprises a rigid body having an upstanding open top peripheral wall with an inturned grooved ledge spaced below the open top, an intermediate section depending from said wall along a diverging path and a separate bottom section depending below the bottom end of the intermediate section, a cover for the open top of the peripheral wall, a hinge swingably mounting said cover on said wall, a handle on the cover to swing the cover from opened to closed positions, an annular locking member fitting in the open top of the bag and in the groove of said ledge depressing the top end of the bag into the groove and suspending the bag from the ledge, said locking member being removeable from the ledge through the open top of the bag when the bag is filled to permit the bag to be tied closed, a second hinge connecting the separate bottom to the bottom of the intermediate section, a locking means opposite said second hinge securing the bottom section in closed position to cover the bottom of the intermediate section, and said locking means being releasable to permit the intermediate section and peripheral wall to swing free of a filled bag in the container when said annular locking member is removed to thereby expose the bag for easy removal.

2. The container of claim 1 wherein said cover has a depending rim embracing said wall and said hinge connects the bottom of the rim with said wall.

3. The container of claim 1 wherein the cover for the peripheral wall has a depending rim embracing said wall, the hinge connects the bottom of said rim with said wall, and the handle is on the rim opposite the hinge.

4. The container of claim 1 wherein the bottom section has a floor peaked upwardly to the center thereof for spreading the bottom of the bag.

5. The container of claim 1 wherein the hinge swingably mounting the cover on the peripheral wall is on the side of the container opposite the second hinge so that the cover and intermediate sections will swing to their open positions in opposite directions.

6. The container of claim 1 wherein the intermediate and bottom sections of the rigid body are rectangular.

* * * * *